US012312149B1

(12) United States Patent
Curiel et al.

(10) Patent No.: US 12,312,149 B1
(45) Date of Patent: May 27, 2025

(54) COMBINED FOOD CONTAINER WITH SAUCE DISPENSER

(71) Applicants: Arnulfo Curiel, Saint Paul, MN (US); Nicholas Anthony Curiel, Chandler, AZ (US)

(72) Inventors: Arnulfo Curiel, Saint Paul, MN (US); Nicholas Anthony Curiel, Chandler, AZ (US)

( * ) Notice: Subject to any disclaimer, the term of this patent is extended or adjusted under 35 U.S.C. 154(b) by 50 days.

(21) Appl. No.: 18/238,710

(22) Filed: Aug. 28, 2023

(51) Int. Cl.
*B65D 81/32* (2006.01)
*B65D 83/68* (2025.01)
*B65D 85/72* (2006.01)

(52) U.S. Cl.
CPC ..... *B65D 81/3222* (2013.01); *B65D 81/3227* (2013.01); *B65D 83/68* (2013.01); *B65D 85/72* (2013.01)

(58) Field of Classification Search
CPC .... B65D 81/3222; B65D 85/72; B65D 83/68; B65D 83/382; B65D 81/32
USPC ..... 206/219, 221; 222/205, 251, 321.7; 215/11.4
See application file for complete search history.

(56) References Cited

U.S. PATENT DOCUMENTS

| | | | | |
|---|---|---|---|---|
| H2044 | H * | 9/2002 | Faughey | B01L 3/0282 141/22 |
| 8,517,219 | B1 * | 8/2013 | Prince | G01F 11/028 141/22 |
| 11,753,218 | B2 * | 9/2023 | Chen | B65D 47/18 222/420 |
| 2006/0273061 | A1 * | 12/2006 | Fricke | B65D 51/24 215/332 |
| 2014/0193550 | A1 * | 7/2014 | Wang | A47J 43/14 426/298 |
| 2015/0266043 | A1 * | 9/2015 | Liu | A45D 34/00 222/255 |
| 2020/0361694 | A1 * | 11/2020 | Lee | B65D 81/3222 |
| 2022/0258949 | A1 * | 8/2022 | Kang | B65D 81/3222 |

* cited by examiner

*Primary Examiner* — Rafael A Ortiz
(74) *Attorney, Agent, or Firm* — Johnson AND Phung; Thomas Phung

(57) ABSTRACT

An improved food storage system that includes a food container having an open and closed, a food-supporting chamber, a removable cover enclosing the open end of the food container, at least one sauce dispensable housing supported by and extending through a portion of the cover with the sauce dispensable housing including a sauce-supporting interior, a sauce dispensing end located within the food-supporting chamber and a sauce fillable open end located external to the food-supporting chamber, and a removable resilient pump enclosing the sauce fillable open end of the sauce dispensable housing in an airtight condition, the rubber pump displaceable towards the removable cover to pressurize the interior of the dispensable housing to induce the dispensing of sauces supported therein into the food-supporting chamber.

18 Claims, 3 Drawing Sheets

COMBINED FOOD CONTAINER WITH SAUCE DISPENSER

FIELD OF THE INVENTION

This invention relates generally to food containers and, more specifically to a food storage system that includes a built-in sauce dispensable housing supported by the cover sauce dispensable housing to provide a quick and on-demand dispensing of sauces supported within the sauce dispensable housing into the food-supporting chamber without removal of the removable cover.

CROSS-REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

The use of portable food containers such as plastic and plastic containers having sealing lids for holding salads and lunches for work is well. For foods that include sauces such as dressing for salads, it is normally preferred that the dressing is held in a separate much smaller container and packed in the lunch bag along with the container housing the salad. The dressing container is then opened, and the salad dressing is poured into the salad container when the salad is about to be eaten.

Since the dressing container is very small, it can be time-consuming to find the dressing container and its associated lid in the container drawer. The dressing container can also oftentimes be overlooked or misplaced in lunch packing the process. In addition, opening the salad dressing container to pour the salad dressing on the salad may lead to accidental spillage on work clothing and work surfaces.

The present invention is directed at solving the above problems by providing a food storage system that includes a portable food container having a built-in sauce dispensable housing.

SUMMARY OF THE INVENTION

Briefly, the present invention comprises an improved food storage system that includes a food container having an open end, a closed, and a food-supporting chamber. Enclosing the open end of the food container is a removable liquid-tight sealing cover and at least one edible sauce dispensable housing supported by and extending through a portion of the cover. The sauce dispensable housing includes a sauce-supporting interior, a sauce dispensing end including a diaphragm with displaceable flaps located within the food-supporting chamber, and a sauce-fillable open end located external to the food-supporting chamber.

Enclosing the sauce fillable open end of the sauce dispensable housing in an airtight condition is a removable resilient pump preferably made from a rubber material and having a semi-circular shaped body. The removable resilient pump is displaceable towards the removable cover to pressurize the interior of the dispensable housing to induce the dispensing of sauces supported therein into the food-supporting chamber.

DESCRIPTION OF THE PREFERRED EMBODIMENT

Figure 1:
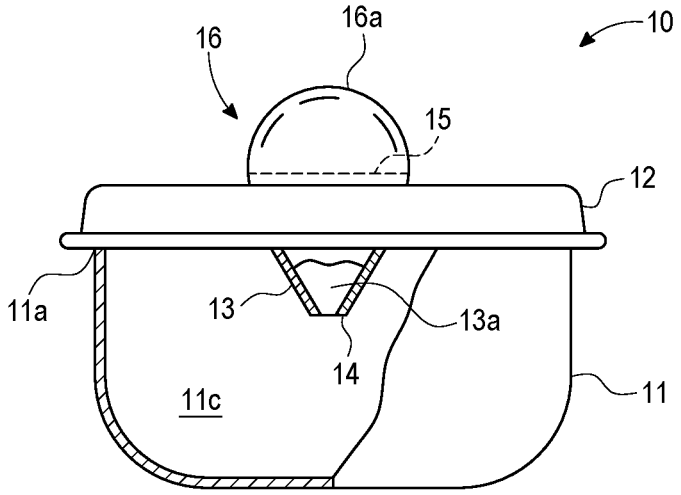
FIG. 1 is a partial cross-sectional side view of an embodiment of an improved food storage system of the present invention.

The general purpose of the present invention, which will be described subsequently in greater detail, is to provide a food storage system that includes a build-in sauce dispensable housing supported by and extending through a portion of the cover sauce dispensable housing to provide a quick and on-demand dispensing of sauces supported within the sauce dispensable housing into the food-supporting chamber, without removal of the removable cover, through the pressurization of the dispensable housing through the displacement of the rubber pump displaceable towards the removable cover.

There has thus been outlined the more important features of the invention in order that the detailed description thereof that follows may be better understood, and in order that the present contribution to the art, may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the disclosing subject matter be regarded as including such equivalent constructions insofar as they do not depart from the spirit and scope of the present invention.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims.

Furthermore, there is no intention to be bound by any expressed or implied theory presented in the preceding technical field, background, brief summary or the following detailed description.

In addition, the accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of any potential claims.

Referring to the drawings, FIG. 1 is a partial cross-sectional side view of an embodiment of an improved food storage system 10 of the present invention which generally includes a bowl-shaped food container 11 having an open end 11*a*, a closed 11*b*, a food-supporting chamber 11*c*, and a removable cover and preferably a removable liquid tight sealing cover 12 enclosing the open end 11*a* of the food container 11.

The removable cover 12 is shown in the embodiment of FIG. 1 having a built-in sauce dispensable housing 13 supported by and extending through a portion of the cover 12. The sauce dispensable housing 13 includes a sauce-supporting interior 13*a*, a sauce dispensing end 14 located within the food-supporting chamber 11*c*, and a sauce-fillable opened end 15 located external to the food-supporting chamber 11*c*.

Enclosing the sauce fillable opened end 15 of the sauce dispensable housing 13 in an airtight condition is a removable resilient pump 16 having a closed end surface 16*a* that is displaceable towards the removable cover 12 to pressurize the sauce-supporting interior 13*a* of the sauce dispensable housing 13 to induce the dispensing of sauces supported therein into the food-supporting chamber 11*c*. Having the sauce dispensable housing 13 built into the cover 12 provides the user benefit of not having to spend time searching in the user's container drawer for a small sauce container and its accompanying cover. In addition, since the sauce may be dispensed into the food container 11 without having to remove the cover 12 or an accompanying cover of a traditional sauce container, accidental spillage on work clothing and work surfaces is greatly reduced or eliminated.

Figure 2:
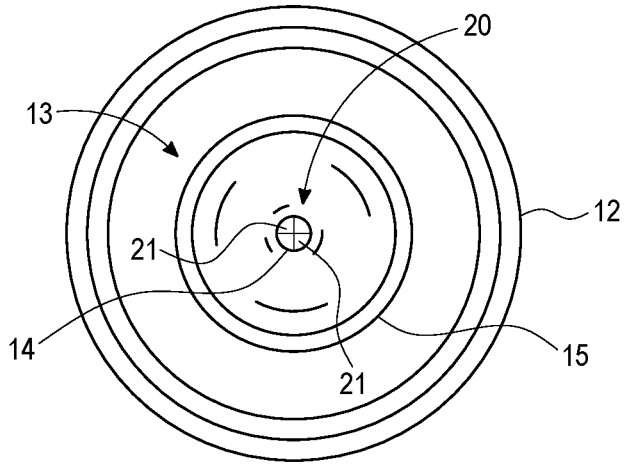
FIG. 2 is a top view showing a removable cover of the improved food storage system of FIG. 1 with a removable resilient pump removed.
Figure 3:
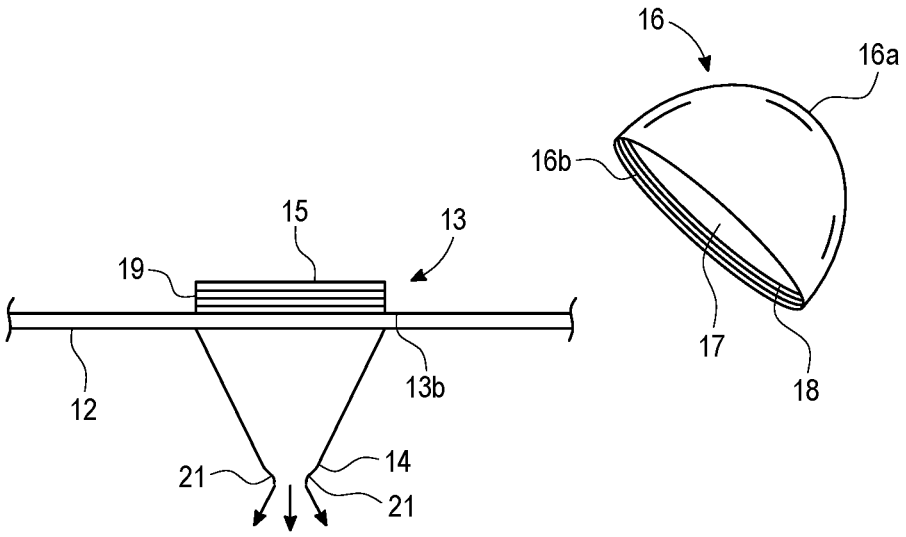
FIG. 3 is a partial side view showing the removable cover of FIG. 2.

FIG. 2 is a top view and FIG. 3 is a partial side view showing the removable cover 12 of FIG. 1 with the removable resilient pump 16 removed. In regard to the sauce dispensing end 14 of the sauce dispensable housing 13, a feature of the present invention is that the sauce dispensing end 14 preferably includes a mechanism or device including but not limited to a diaphragm or gasket-based device that functions to maintain the edible sauce within the sauce-supporting interior 13*a* until the user displaces the closed end surface 16*a* of the removable resilient pump 16 towards the removable cover 12 to induce the dispensing of sauce into the food-supporting chamber 11*c*.

FIGS. 2 and 3 show the sauce dispensing end 14 having a diaphragm device 20 with displaceable flaps 21 that functions to maintain the edible sauce within the sauce-supporting interior 13*a* and move outwardly and away from each other under pressure within the sauce-supporting interior 13*a* created by the displacement of the closed end surface 16*a* of the removable resilient pump 16 towards the removable cover 12 enabling the dispensing of edible sauce that is supported within the sauce dispensable housing 13.

Although the removable resilient pump 16 may enclose the sauce fillable opened end 15 of the sauce dispensable housing 13 in a plurality of manner, the removable resilient pump 16 of FIGS. 1 and 3 are shown secured to the sauce dispensable housing 13 through a screw-on threaded connection made by the mating engagement between a plurality of threads 18 located on an interior surface 17 of the removable resilient pump 16 proximal an open end 16*b* of the removable resilient pump 16 with a plurality of threads 19 located on an exterior surface 13*b* of the sauce dispensable housing 13 proximal the sauce fillable opened end 15 of the sauce dispensable housing 13.

In addition, although the removable resilient pump 16 may be made from a plurality of resilient or semi-resilient materials such as a resilient plastic material or the like and may come in various shapes, the removable resilient pump 16 is preferably made from a rubber material and comprise a semi-circular shaped body.

Figure 4:
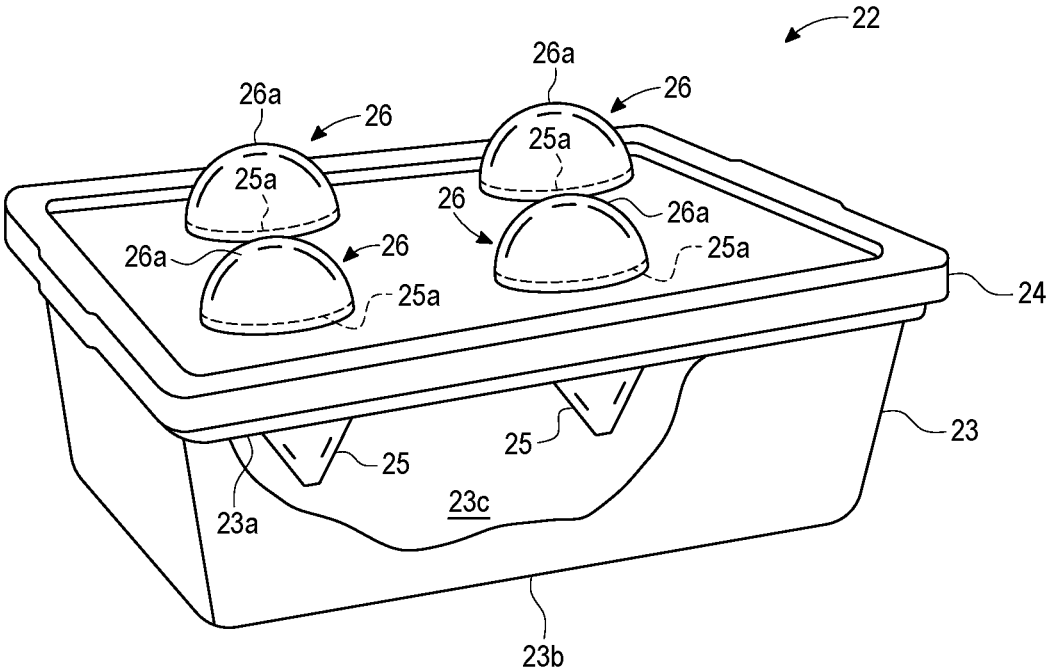
FIG. 4 is a partial cross-sectional perspective view showing an alternative embodiment of a food storage system of the present invention.

FIG. 4 is a partial cross-sectional perspective view showing an alternative embodiment of a food storage system 22 of the present invention which includes similar general components to the food storage system 10 shown in FIGS. 1-3, namely a food container 23 having an open end 23*a*, a closed 23*b*, a food-supporting chamber 23*c*, and a removable cover 24 enclosing the open end 23*a* of the food container 23. However, instead of having one sauce dispensable housing 13 supported by and extending through a portion of the removable cover 12, the food storage system 22 is shown having four sauce dispensable housings 25 each supported by and extending through the portion of the removable cover 24 in a spaced condition from each other.

Enclosing a sauce fillable opened end 25*a* of each sauce dispensable housing 25 in an airtight condition is a removable resilient pump 26 having a closed end surface 26*a* that is displaceable towards the removable cover 24 to pressurize the sauce dispensable housing 25 to induce the dispensing of sauces supported therein into a food-supporting chamber 23*c* of food container 23. It is noted that the sauces in each of the dispensable housings 25 may be dispensed simultaneously into the food container 23 or at different times within the food container. In addition, the sauces in each of the dispensable housings 25 may be all be the same type of sauce or different types of sauces.

Figure 5:
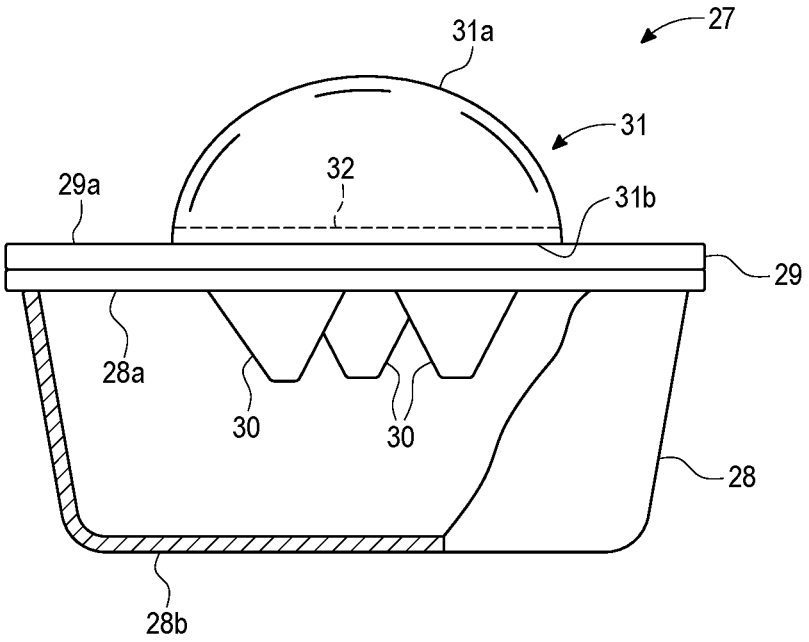
FIG. 5 is a partial cross-sectional side view showing an alternative embodiment of a food storage system having a resilient pump covering three sauce dispensable housings.
Figure 6:
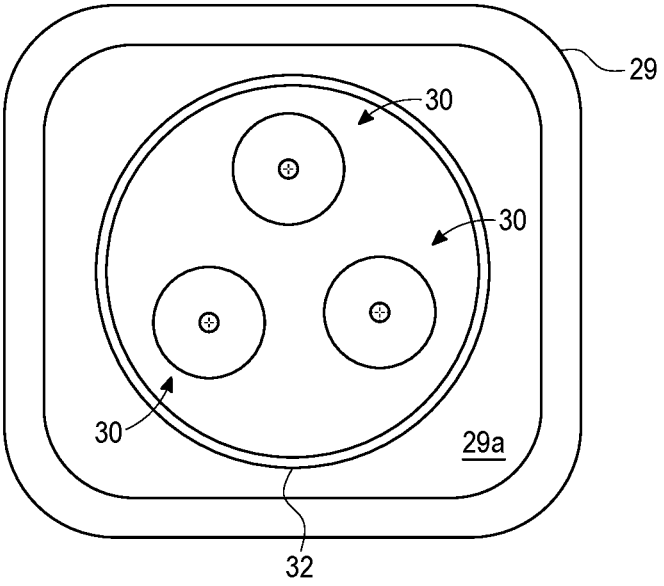
FIG. 6 is a top view showing a removable cover of FIG. 5 with the resilient pump removed.

Referring to FIGS. 5 and 6, FIG. 5 is a partial cross-sectional side view showing an alternative embodiment of a food storage system 27 of the present invention which includes similar general components to the food storage system 10 shown in FIGS. 1-3, namely a food container 28 having an open end 28*a*, a closed 28*b*, a food-supporting chamber 28*c*, and a removable cover 29 enclosing the open end 28*a* of the food container 28.

However, instead of having one sauce dispensable housing 13 supported by and extending through a portion of the removable cover 12, the food storage system 27 is shown having three sauce dispensable housings 30 that are centrally located on the removable cover 29 with each of the sauce dispensable housings 30 supported by and extending through a portion of the removable cover 29 in a spaced condition from each other.

However, unlike the sauce dispensable housing 13 of FIGS. 1-3 and the sauce dispensable housings 25 of FIG. 4, each of the sauce dispensable housing 30 does not include a separate removable resilient pump attached to the corresponding sauce dispensable housing. Instead, the food storage system 27 is shown as having a single removable resilient pump 31 centrally located on the removable cover 29. The single removable resilient pump 31 is shown enclosing all three of the sauce dispensable housing 30 in a preferably airtight condition wherein the displacement of a closed-end surface 31*a* of the removable resilient pump 31 towards the removable cover 29 pressurizes all three of the sauce dispensable housings 30 to induce the dispensing of sauces supported in each of the sauce dispensable housings 30 into the food-supporting chamber 28*c*.

FIG. 6 is a top view showing the removable cover 29 of FIG. 5 with the removable resilient pump 31 removed. As shown, instead of the open end 16*b* of each of the removable resilient pump 16 attached to the sauce fillable opened end 15 of the corresponding dispensable housing 13, the single removable resilient pump 31 is shown enclosing the sauce dispensable housings 30 through the connection of an open end 31*b* of the removable resilient pump 31 with a securement ring 32 extending from a top surface 29*a* of the removable cover 29.

We claim:

1. An improved food storage system comprising:

a food container having an open end, a closed, and a food-supporting chamber;

a removable cover enclosing said open end of said food container;

a securement ring extending from a top surface of the removable cover;

at least three sauce dispensable housings located within the securement ring on said removable cover in a spaced condition from each other, said sauce dispensable housings each including a sauce-supporting interior, a sauce dispensing end located within said food-supporting chamber and a sauce fillable open end located external to said food-supporting chamber;

a single removable resilient pump attached to the securement ring to enclose said sauce dispensable housings in an airtight condition, said resilient pump displaceable towards said removable cover to pressurize the interior of said dispensable housings to induce the dispensing of sauces supported therein into said food-supporting chamber.

2. The improved food storage system of claim 1 wherein said removable resilient pump is made from a resilient plastic material.

3. The improved food storage system of claim 1 wherein said removable resilient pump is made from a rubber material.

4. The improved food storage system of claim 1 wherein said removable resilient pump is attached to said securement ring by a screw-on threaded connection.

5. The improved food storage system of claim 1 wherein said at least three sauce dispensable housing comprises at least four sauce dispensable housings.

6. The improved food storage system of claim 1 wherein said removable resilient pump comprises a semi-circular shaped body.

7. The improved food storage system of claim 1 wherein said removable cover comprises a removable liquid tight sealing cover.

8. The improved food storage system of claim 1 wherein the sauce dispensing end of said sauce dispensable housing includes a diaphragm having displaceable flaps.

9. The improved food storage system of claim 1 wherein said removable resilient pump is centrally located on said removable cover.

10. An improved food storage system comprising:

a food container having an open end, a closed, and a food-supporting chamber;

a removable cover enclosing said open end of said food container;

a securement ring extending from a top surface of the removable cover;

at least three sauce dispensable housings located within the securement ring on said removable cover in a spaced condition from each other, said sauce dispensable housings each including a sauce-supporting interior, a sauce dispensing end located within said food-supporting chamber and a sauce fillable open end located external to said food-supporting chamber;

a single removable resilient pump attached to the securement ring to enclose said sauce dispensable housings in an airtight condition, said removable resilient pump made from a rubber material and having a semi-circular shaped body, said removable resilient pump displaceable towards said removable cover to pressurize the interior of said dispensable housings to induce the dispensing of sauces supported therein into said food-supporting chamber.

11. The improved food storage system of claim 10 wherein said removable resilient pump is attached to said securement ring by a screw-on threaded connection.

12. The improved food storage system of claim 11 wherein the sauce dispensing end of each of said sauce dispensable housing includes a diaphragm having displaceable flaps.

13. The improved food storage system of claim 12 wherein said removable cover comprises a removable liquid tight sealing cover.

14. The improved food storage system of claim 13 wherein said at least three sauce dispensable housings comprises at least four sauce dispensable housings.

15. The improved food storage system of claim 12 wherein said removable resilient pump is centrally located on said sealing cover.

16. An improved food storage system comprising:

a food container having an open end, a closed, and a food-supporting chamber;

a removable liquid tight sealing cover enclosing said open end of said food container;

a securement ring extending from a top surface of the removable cover;

at least three edible sauce dispensable housings located within the securement ring on said removable liquid tight sealing cover in a spaced condition from each other, said sauce dispensable housings each including a sauce-supporting interior, a sauce dispensing end including a diaphragm with displaceable flaps located within said food-supporting chamber and a sauce-fillable open end located external to said food-supporting chamber;

a single removable resilient pump attached to the securement ring to enclose said sauce dispensable housings in an airtight condition, said removable resilient pump made from a rubber material and having a semi-circular shaped body, said removable resilient pump displaceable towards said removable cover to pressurize the interior of said dispensable housings to induce the dispensing of sauces supported therein into said food-supporting chamber.

17. The improved food storage system of claim 16 wherein said removable resilient pump is attached to said securement ring by a screw-on threaded connection.

18. The improved food storage system of claim 16 wherein said at least three sauce dispensable housing comprises at least four sauce dispensable housing.

* * * * *